United States Patent [19]

Goseberg et al.

[11] Patent Number: 4,806,831

[45] Date of Patent: Feb. 21, 1989

[54] COIL WITH MAGNETIZABLE ROD CORE

[75] Inventors: Walter Goseberg; Alfred Pollack, both of Hanover, Fed. Rep. of Germany

[73] Assignee: TELEFUNKEN Fernseh und Rundfunk, Hanover, Fed. Rep. of Germany

[21] Appl. No.: 62,186

[22] Filed: Jun. 15, 1987

Related U.S. Application Data

[63] Continuation of Ser. No. 06/765,967, Aug. 15, 1985.

[30] Foreign Application Priority Data

Aug. 16, 1984 [DE] Fed. Rep. of Germany ..... 3429976

[51] Int. Cl.[4] ..... H01J 29/70; H01J 29/76; H01F 27/28

[52] U.S. Cl. ..... 315/399; 315/364; 336/180

[58] Field of Search ..... 315/364, 399, 400, 411; 336/130, 136, 180, 181, 182, 183

[56] References Cited

U.S. PATENT DOCUMENTS

| | | | |
|---|---|---|---|
| 2,182,071 | 12/1939 | Crossley | 336/136 |
| 2,196,809 | 4/1940 | Hoadley | 336/136 |
| 2,507,344 | 5/1950 | Macgeorge | 336/136 |
| 2,564,221 | 8/1951 | Hornfeck | 336/136 |
| 2,985,854 | 5/1961 | Brosh | 336/136 |
| 3,017,589 | 1/1962 | Chass | 336/136 |
| 3,054,976 | 9/1962 | Lipshutz | 336/136 |
| 3,089,081 | 5/1963 | Brosh | 336/136 |
| 3,113,237 | 12/1963 | Schopp et al. | 336/136 |
| 3,197,722 | 7/1965 | Chass | 336/136 |
| 3,594,671 | 7/1971 | Frenkel | 336/183 |
| 3,594,672 | 7/1971 | Frenkel | 336/183 |
| 4,229,786 | 10/1980 | Mitani et al. | 336/185 |
| 4,680,566 | 7/1987 | Goseberg et al. | 336/181 |

*Primary Examiner*—Theodore M. Blum
*Assistant Examiner*—Gregory C. Issing
*Attorney, Agent, or Firm*—Spencer & Frank

[57] ABSTRACT

A coil arrangement with three windings arranged coaxially, where the outer coils are connected in series. The inductances of the outer coils are of equal magnitude and their magnetic fields have opposing polarities.

The center winding induces currents in the series circuit of the outer windings which cancel each other out. The outer windings with their stray inductances form a coil which is separated from the center one and can be applied for other purposes.

13 Claims, 2 Drawing Sheets

COIL WITH MAGNETIZABLE ROD CORE

This is a continuation of application Ser. No. 06/765,967 filed Aug. 15th, 1985.

BACKGROUND OF THE INVENTION

In apparatus for telecommunications, a method is well known by which coils which are magnetically coupled are arranged coaxially or superimposed on one coil form. A magnetizable iron core is immersed in the form, so as to influence the mutual coupling of the coils and the magnitude of the inductances. For simple coil arrangements, this iron core takes the form of a rod core. For a required change in the parameters, the rod core is provided with a thread and its position relative to the coils can be changed. The frequency of the current is common to the individual coil components in such a construction.

If the individual windings of a coil are used with different or equal frequencies but for separate electrical applications, care must be taken that the mutual coupling of the coils is minimised. The coupling must be so small that there is no mutual magnetic effect. In order to achieve such a solution, a method is well known by which a magnetic iron core with a double E shape is used. The two E-shaped parts are so assembled here that a rectangle with two apertures is produced. The windings are made on the two outer limbs. The magnetic isolation is obtained by cutting an air gap in the outer limbs of the E-shaped iron core, whereas the iron components are in contact in the central stem. The magnetic flux inside the individual windings is thus determined by the air gap inside the winding, while in the central stem which is common to both coils the air gap is kept as small as possible, so that the magnetic coupling of the two coils is of minimum magnitude, and this makes possible the separate use of the two coils with e.g. different frequencies. In order to secure the smallest possible air gap in the central stem when the two sections are joined together, this surface is made as flat as possible by special working. Since such an arrangement with two E-shaped iron components is very expensive, the invention is concerned with the problem of providing a coil with several windings for a variety of applications and having only one iron core.

SUMMARY OF THE INVENTION

The above problem is solved according to the present invention in that a coil with a magnetisable rod core having three coaxially positioned windings distributed roughly uniformly with respect to the rod and with the two outer windings having an approximately equal number of turns; the rod core is positioned so that it simultaneously is fully immersed in the center winding and partially or fully immersed in the two outer windings such that the two outer windings have approximately equal inductances, the outer windings are connected in series such that their magnetic fields in the rod core are mutually opposed, and the center winding is conductively, i.e., galvanically, isolated from the two outer windings. Advantageous developments of the invention are described in the subsequent claims.

In principle, magnetic fields of different magnitudes can be produced by the application of an alternating voltage to the common axis of two series connected coils of equal inductance, depending on their relative polarities, arranged coaxially on one coil form. When the coil polarities are the same this magnetic field attains a certain value, whereas with opposed polarities the resultant magnetic field can hardly be detected or not at all. This feature is utilised in the solution using a coil arrangement with a rod core, in order to produce coils for different tasks and with different frequencies. If a third winding is introduced between the coaxially arranged series connected and polarity opposed windings, the third coil will be approximately free of field lines from the outer windings and can be used as a separate coil. Where the inductances are different, it is advantageous to locate the coil with the larger inductance in the middle, since when a rod core is used this is fully immersed and there are no induction losses as in the outer coil due to the polarity opposed windings. Manufacturing tolerances can be compensated during assembly by displacement of the rod core, so that the outer windings have exactly the same inductances and exhibit opposed magnetic fields of equal magnitude when an alternating voltage is applied. The polarity opposed connection of the outer windings creates inductive losses. In spite of these inductive losses an adequate inductance is obtained for the outer windings as a result of stray fields.

BRIEF DESCRIPTION OF THE DRAWINGS

For the better understanding of the invention examples of embodiments will be explained below with reference to the drawings.

DETAILED DESCRIPTION OF THE PREFERRED EMBODIMENTS

Figure 1:
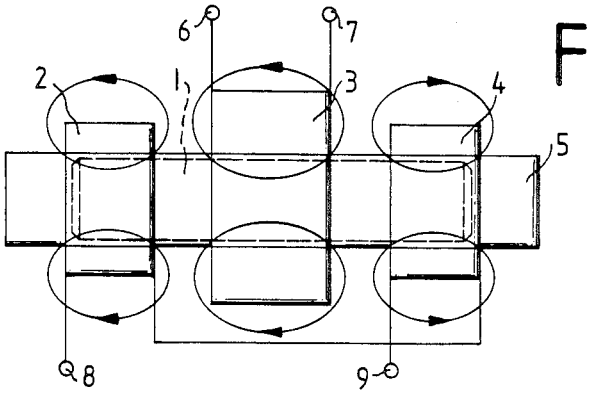
FIG. 1 shows a schematic drawing, of a coil according to the invention.

FIG. 1 shows a coil with three windings 2, 3, and 4 with winding connections 6,7,8, and 9. The windings are formed coaxially on a coil form 5. The form 5 contains a magnetisable rod core 1, which can be displaced in its position relative to the windings. The outer windings 2 and 4 are so arranged that the rod core 1 ends approximately at the outer edges of the coil. The windings 2 and 4 are series connected in such a way as to oppose each other magnetically. The direction of the magnetic fields is indicated by the sketched magnetic field lines. The relative separation of the outer windings 2, 4 and their polarity ensures that the magnetic coupling of these windings is such that an adequate inductance can still be obtained. The decoupling of the centre winding 3 is optimal when the rod core is so adjusted that the magnetic fields of the outer windings 2, 4 are of equal magnitude. Since the rod core 1 is fully immersed in the centre winding 3, the field lines of this coil are closed in the way depicted, where the direction of the field lines and the applied frequency are selectable. The centre winding 3 induces in the outer windings 2 and 4 currents which are of equal magnitude and cancel each other out because of the opposing polarities.

Figure 2:
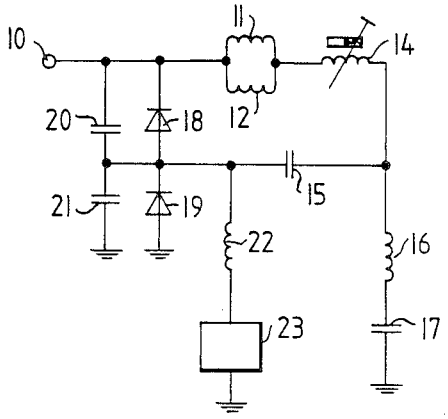
FIG. 2 shows a part of a horizontal deflection circuit in a television apparatus having horizontal pincushion distortion, for which the invention can find useful application.

FIG. 2 shows a part of a horizontal deflection circuit in a television apparatus with an input 10, the deflection coils 11,12, the linearity adjustment 14, the tangent capacitor 15, the bridge coil 16, the parallel capacitance 17, the diodes 18,19, the fly-back capacitors 20,21, the horizontal drive coil 22 and the horizontal circuit 23.

In a preferred example of an embodiment according to the invention the centre winding 3 is applied as the horizontal drive coil with approximately 6 mH, and the series circuit formed by the outer windings 2,4 is used as a bridge coil with about 1.7 mH in a television apparatus. It is advantageous for rational manufacture to effect all windings with the same wire diameter. The outer windings 2,4 can be wound in the same direction depending on the connection sequence, or they may be wound in opposite directions. If different wire diameters are used, it is preferable to arrange the horizontal drive coil on the outer sections and the bridge coil on the centre section.

Figure 3:
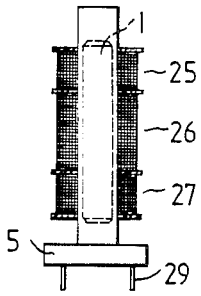
FIG. 3 shows an an embodiment of a coil according to the invention.

FIG. 3 shows a rod core 1 in a coil form 5 with coil sections 25,26,27 and the connection pins 29. In this example of an embodiment the rod core 1 extends outside the coil sections 25 and 27. One of the advantages of a coil with equal wire diameters is an optimal winding technique, in particular with automatically manufactured coils. For this reason the coil sections 25 and 27 are wound in a single operation. This is done as follows:

Section 25 is wound, and then in section 26 a transition winding is applied up to section 27 with the same winding sense as section 25, section 27 is wound in the opposite sense to section 25. Then a transition winding is applied in section 26 in the same winding sense as section 27 and led out. Finally section 26 is wound in an arbitrary direction.

Figure 4:
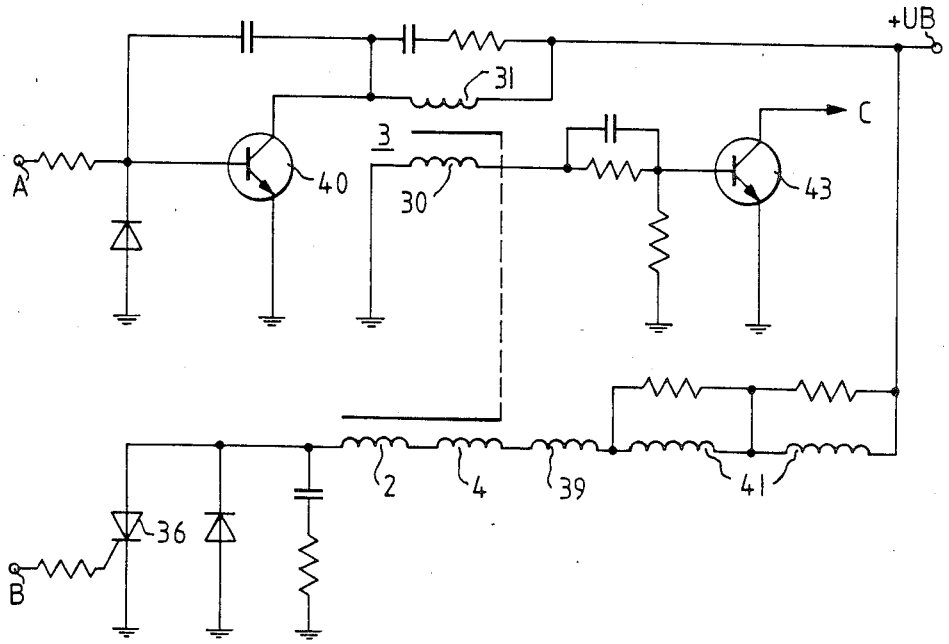
FIG. 4 shows a part of a vertical deflection circuit in a television apparatus, having a vertical integration coil and the drive part for a horizontal deflection circuit having a line driver transformer.

FIG. 4 shows a part of a vertical deflection circuit in a television receiver having a vertical integration coil and the drive part for a horizontal deflection circuit having a line driver transformer.

Impulses are applied to the connection A from an impulse source, for the control of the current in the horizontal deflection coils. They are amplified in the transistor 40, the collector of which is connected to one end of the primary winding 31 of the line driver transformer 3. The other end of the primary winding 31 is connected to the supply voltage +UB. The impulses from the secondary winding 30 arrive at the input of the line end transistor 43, from the collector connection C of which the non-illustrated horizontal deflection coils and the line transformer are driven.

Impulses for the vertical deflector are applied to the connection B from an impulse generator. Thyristor 36 is to be taken as a switch, by means of which the horizontal flyback impulses, applied in synchronism with the horizontal frequency to the series connection of the vertical deflection coils 41 with the vertical integration coil 2,4, are switched from the winding 39 of the line transformer which is also connected in series. The waveform of the vertical deflection voltage is so shaped by the vertical integration coil 2,4 that lines with equal vertical separation are described on the picture screen.

The coils 30,31 and 2,4 are arranged on a rod core 1 which is indicated by the linking dotted line as a common iron core.

Figure 5:
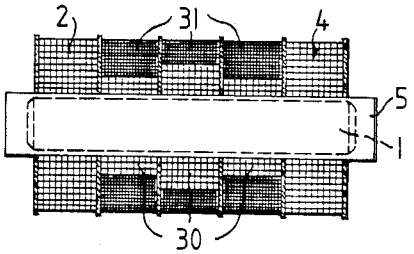
FIG. 5 shows the arrangement according to the invention of the windings for the line driver transformer and for the vertical integration coil according to FIG. 4.

FIG. 5 shows the arrangement of the windings for the line driver transformer and for the vertical integration coil according to FIG. 4.

The iron core 1, formed as a rod core, is arranged in a coil form 5 having five coil sections, substantially centrally with respect to the sections. The outer sections contain the coil components of the vertical integration coil 2,4 having opposed polarities. As a result of this opposed polarity winding method, stray fields are kept so remote that an expensive ferrite container is not necessary for shielding purposes.

The line driver transformer is distributed in the three middle sections. The secondary winding 30 is disposed as the under winding adjacent the iron core 1. The winding distribution is so selected that the middle section has a greater number of secondary turns than the adjacent sections, whereby an optimum field distribution is made possible, so that an opposite influence from the line driver transformer and the vertical integration coil can be minimised. On account of the larger cross section of wire, and also on account of the high currents, it has proved to be desirable to arrange the secondary coil in the under-coil positions of the three middle sections. Desirably these are wound with the same wire as used for the vertical integration coils.

The primary winding 31 is applied as the last winding on the secondary winding 30 which lies underneath.

We claim:

1. A coil arrangement comprising a magnetizable rod core and at least first, second and third adjacent coaxially positioned windings arranged approximately symmetrically with respect to said rod core, with said first and third windings being the outer of said adjacent windings and having approximately the same number of turns; and wherein: said first and third windings are connected in series opposition so that their respective magnetic fields act opposite one another in said rod core; said rod core is fixedly positioned so that it extends fully through said second winding and at least partially into each of said first and third windings, and so that said first and third windings have approximately equal inductances, whereby said series connected first and third windings are electromagnetically decoupled from said second winding; and said second winding is electrically isolated from said first and third windings, whereby said second winding and said series connected first and third windings can be connected in respectively separate circuits which may have different operating frequencies.

2. Coil arrangement according to claim 1 wherein all of said windings are wound in the same sense.

3. Coil arrangement according to claim 1, wherein said outer windings are wound in opposite senses.

4. Coil arrangement according to claim 1, wherein said rod core consists of a ferromagnetic material, in particular ferrite.

5. Coil arrangement according to claim 1, wherein all three windings are wound with wire of the same diameter.

6. Coil arrangement according to claim 1, wherein said second winding has the greater inductance.

7. A method of using a coil arrangement including a magnetizable rod core and at least first, second and third adjacent coaxially positioned windings arranged approximately symmetrically with respect to said rod core, with said first and third windings being the outer of said adjacent windings, having approximately the same number of turns, and being connected in series opposition so that their respective magnetic fields act opposite one another in said rod core, and wherein said second winding is electrically isolated from said first and third windings, and said rod core is fixedly positioned so that it extends fully through said second winding and at least partially into each of said first and third windings, and so that said first and third windings have approximately equal inductances, whereby said series connected first and third windings are electromagnetically decoupled from said second winding, said method comprising: connecting one of said second winding and said series connected first and third windings as the horizontal drive coil of the horizontal deflection circuit of a television receiver; and connecting the other of said second winding and said series connected first and third windings as the bridge coil of said horizontal deflection circuit.

8. A method of using a coil arrangement including a magnetizable rod core and at least first, second and third adjacent coaxially positioned windings arranged approximately symmetrically with respect to said rod core, with said first and third windings being the outer of said adjacent windings, having approximately the same number of turns, and being connected in series opposition so that their respective magnetic fields act opposite one another in said rod core, a fourth winding disposed only above said second winding, and wherein said second winding is electrically isolated from said first and third windings, and said rod core is fixedly positioned so that it extends fully through said second winding and at least partially into each of said first and third windings, and so that said first and third windings have approximately equal inductances, whereby said series connected first and third windings are electromagnetically decoupled from said second winding, said method comprising: connecting said series connected first and third windings in series with the vertical deflection coil of a television receiver as the vertical integrating coil of a vertical deflection circuit; connecting said second winding as the secondary winding of a line drive transformer for the horizontal deflection circuit for the television receiver; and connecting said fourth winding as the primary winding of said line drive transformer for the horizontal deflection circuit of the television receiver.

9. A method as defined in claim 8 wherein: said step of connecting said second winding comprises connecting said second winding in series with the input of a line end transistor for the horizontal deflection coils; and said step of connecting said fourth winding comprises connecting said fourth winding in series with the output of an amplifying transistor for horizontal line drive impulses.

10. A method of using a coil arrangement including a magnetizable rod core and first, second and third adjacent coaxially positioned windings arranged approximately symmetrically with respect to said rod core, with said first and third windings being the outer of the three said adjacent windings, having approximately the same number of turns and being connected in series opposition so that their respective magnetic fields act opposite one another in said rod core, said method comprising: fixedly positioning said rod core so that it extends fully through said second winding and at least partially into each of said first and third windings and so that said first and third windings have approximately equal inductances; connecting said second winding as the horizontal drive coil for the horizontal deflection coils of the horizontal deflection circuit of a television receiver; and connecting said series connected first and third windings as the bridge coil of said horizontal deflection circuit of the television receiver.

11. A method of using a coil arrangement including a magnetizable rod core, first, second and third adjacent coaxially positioned windings arranged approximately symmetrically with respect to said rod core, and a fourth winding symmetrically disposed above only said second winding, and wherein said first and third windings are the outer of the three said adjacent windings, have approximately the same number of turns and are connected in series opposition so that their respective magnetic fields act opposite one another in said rod core, said method comprising: fixedly positioning said rod core so that it extends fully through said second winding and at least partially into each of said first and third windings and so that said first and third windings have approximately equal inductances; connecting said series connected first and third windings into the vertical deflection circuit of a television receiver; and connecting said second and fourth windings into the horizontal deflection circuit of the television receiver.

12. A method as defined in claim 11 wherein: said step of connecting said series connected first and third windings comprises connecting said first and third windings in series with the vertical deflection coils of the television receiver as the vertical integration coil; and said step of connecting said second and fourth windings includes connecting said second and fourth windings as the secondary winding and the primary winding respectively of a line drive transformer of the horizontal deflection circuit of the television receiver.

13. A method as defined in claim 12 wherein said second winding is connected in series with the input of a line end transistor for the horizontal deflection coils and said fourth winding is connected in series with the output of an amplifying transistor for horizontal line drive impulses.

* * * * *

UNITED STATES PATENT AND TRADEMARK OFFICE

CERTIFICATE OF CORRECTION

PATENT NO. : 4,806,831

DATED : February 21, 1989

INVENTOR(S) : Walter Goseberg; Alfred Pollack

It is certified that error appears in the above-identified patent and that said Letters Patent is hereby corrected as shown below:

In the heading of the patent, under [30], under the first priority insert a second priority as follows:

July 18, 1985 [DE] Fed. Rep. of Germany.....3525649

Signed and Sealed this

Nineteenth Day of September, 1989

*Attest:*

DONALD J. QUIGG

*Attesting Officer*

*Commissioner of Patents and Trademarks*